US010088171B2

(12) United States Patent
Lee et al.

(10) Patent No.: US 10,088,171 B2
(45) Date of Patent: Oct. 2, 2018

(54) COOKING DEVICE

(71) Applicant: LG ELECTRONICS INC., Seoul (KR)

(72) Inventors: Sangcheol Lee, Seoul (KR); Wontae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 249 days.

(21) Appl. No.: 14/969,523

(22) Filed: Dec. 15, 2015

(65) Prior Publication Data

US 2016/0169535 A1 Jun. 16, 2016

(30) Foreign Application Priority Data

Dec. 15, 2014 (KR) ..... 10-2014-0180164
Dec. 15, 2014 (KR) ..... 10-2014-0180165

(51) Int. Cl.
*F24C 15/20* (2006.01)

(52) U.S. Cl.
CPC ..... *F24C 15/2092* (2013.01); *F24C 15/2042* (2013.01); *F24C 15/2071* (2013.01)

(58) Field of Classification Search
None
See application file for complete search history.

(56) References Cited

U.S. PATENT DOCUMENTS 424,628 A * 4/1890 Taylor ..... F24C 15/2092 126/301
499,210 A * 6/1893 Canavan ..... F24C 15/2092 126/299 D
514,003 A * 2/1894 Hornor et al. ..... F24C 15/2092 126/299 D
792,817 A * 6/1905 Evans ..... E05F 15/627 49/347
818,003 A * 4/1906 Thorelius ..... F24C 15/2092 126/299 D
913,465 A * 2/1909 Brouillet ..... F24C 15/2092 126/299 D
1,686,617 A * 10/1928 Juralewicz ..... F24C 15/20 126/299 R (Continued)

FOREIGN PATENT DOCUMENTS

DE 2206904 9/1973
KR 10-2005-0031781 4/2005
KR 10-2008-0043912 5/2008

OTHER PUBLICATIONS

Partial European Search Report issued in European Application No. 15198449.9 dated May 3, 2016, 8 pages.

*Primary Examiner* — Avinash Savani
*Assistant Examiner* — Martha Becton
(74) *Attorney, Agent, or Firm* — Fish & Richardson P.C.

(57) ABSTRACT

A cooking device includes a main body with a cooking space, and a hood provided at the lower side of the main body, the hood is configured to suction air and includes a hood casing, a movable part that is configured to be withdrawn from the hood casing and a suction part with a front suction port, where the front suction port is exposed to an outside of the hood casing based on the movable part being withdrawn from the hood casing, and the front suction portion is not exposed to the outside of the hood casing based on the movable part being inserted in the hood casing.

15 Claims, 13 Drawing Sheets

(56) References Cited

U.S. PATENT DOCUMENTS 2,535,707 A * 12/1950 Vezey, Jr. ..... F24C 15/2092 126/299 D
2,582,884 A * 1/1952 Nicol ..... F24C 15/2092 126/299 D
2,595,480 A * 5/1952 Nelson ..... F24C 15/2007 126/21 A
2,750,867 A * 6/1956 Meyer ..... F24C 15/2064 126/299 D
3,011,492 A * 12/1961 Humbert ..... F24C 15/12 126/299 R
3,031,946 A * 5/1962 Watt ..... F24C 15/2092 126/299 R
3,102,533 A * 9/1963 Jenn ..... F24C 15/12 126/303
3,249,037 A * 5/1966 Stalker ..... F24C 15/2021 126/299 E
3,344,554 A * 10/1967 Misaka ..... E05F 15/63 318/257
3,356,008 A * 12/1967 Simpson ..... F24C 15/2042 126/299 D
3,359,885 A * 12/1967 Fachling ..... F24C 15/2092 126/299 D
3,496,704 A * 2/1970 Bandlow ..... F24C 15/2092 126/299 D
4,614,177 A * 9/1986 Buckley ..... F24C 15/2071 126/299 D
6,622,717 B1 * 9/2003 Kim ..... F24C 15/2042 126/299 D
6,686,576 B1 * 2/2004 Yang ..... F24C 15/2092 126/299 D
6,717,123 B1 * 4/2004 Kim ..... H05B 6/6429 126/273 A
6,992,273 B2 * 1/2006 Yim ..... F24C 15/2028 126/21 A
7,770,959 B2 * 8/2010 Browne ..... E05B 47/0009 292/38
8,066,000 B2 * 11/2011 Tsakiris ..... F24C 15/2071 126/299 D
2002/0029696 A1 * 3/2002 Grimm ..... F24C 15/2042 99/403
2003/0218012 A1 * 11/2003 Kim ..... F24C 15/2042 219/757
2004/0004077 A1 * 1/2004 Jeong ..... F24C 15/2092 219/757
2004/0016754 A1 * 1/2004 Yang ..... F24C 15/2092 219/757
2004/0050844 A1 * 3/2004 Yang ..... H05B 6/6429 219/757
2006/0128298 A1 * 6/2006 Grobleben ..... F24C 15/2021 454/56
2006/0231553 A1 * 10/2006 Gerami ..... B08B 15/02 219/757
2007/0137636 A1 * 6/2007 Mack ..... F24C 15/2092 126/299 D
2007/0295324 A1 * 12/2007 Feisthammel ..... F24C 15/2021 126/299 D
2008/0083402 A1 * 4/2008 Neumann ..... F24C 15/2064 126/299 D
2008/0100092 A1 * 5/2008 Gao ..... E05F 15/60 296/146.11
2008/0121223 A1 * 5/2008 Grobleben ..... F24C 15/2092 126/299 D
2008/0264933 A1 10/2008 Jeong
2010/0065038 A1 * 3/2010 Davies ..... F24C 15/2042 126/299 D
2010/0200576 A1 * 8/2010 Song ..... F24C 15/2092 219/756
2010/0200578 A1 * 8/2010 Song ..... F24C 15/2021 219/757
2013/0134156 A1 * 5/2013 Yu ..... H05B 6/6408 219/757
2013/0240509 A1 * 9/2013 Kim ..... H05B 6/6423 219/757
2014/0042156 A1 2/2014 Kim et al.
2015/0083106 A1 * 3/2015 Jeong ..... F24C 15/322 126/21 A
2016/0273779 A1 * 9/2016 Kim ..... F24C 15/2042

* cited by examiner

COOKING DEVICE

CROSS-REFERENCE TO RELATED APPLICATION(S)

This application claims priority under 35 U.S.C. § 119 and 35 U.S.C. § 365 to Korean Patent Application No. 10-2014-0180164, filed in Korea on Dec. 15, 2014, and Korean Patent Application No. 10-2014-0180165, filed in Korea on Dec. 15, 2014 whose entire disclosures are hereby incorporated by reference.

FIELD

The present disclosure relates to a cooking device.

BACKGROUND

A cooking device is a device that cooks food using a heating source. A cooking device that has a hood function is referred to as an over-the-range (OTR) type cooking device. The OTR type cooking device may be installed at one side of a kitchen. More specifically, the OTR type cooking device is installed above another cooking device, e.g., a gas oven range.

Korean Patent No. 0624676 (registered on Sep. 9, 2006), which is a prior art document, describes a wall-mounted microwave oven. In the described wall-mounted microwave oven, an exhaust duct is provided at a lower portion of a main body, and a guide member is withdrawn from the main body, and is bent downward while being withdrawn by a plurality of guide pieces.

SUMMARY

The present disclosure is directed to a cooking device which has improved suction performance of contaminated air.

According to one aspect, a cooking device may include a main body with a cooking space, and a hood provided at the lower side of the main body, the hood may be configured to suction air and may include a hood casing, a movable part that may be configured to be withdrawn from the hood casing and a suction part with a front suction port, where the front suction port may be exposed to an outside of the hood casing based on the movable part being withdrawn from the hood casing, and the front suction portion may not be exposed to the outside of the hood casing based on the movable part being inserted in the hood casing.

Implementations according to this aspect may include one or more of the following features. For example, the suction part may be tiltably connected to the movable part, and where the suction part may be tilted downward while being withdrawn from the hood casing together with the movable part. The suction part may include a bottom portion with a bottom suction port. The hood may include a tilting limitation part that limits a tiliting angle of the suction part. The tilting limitation part may include a guide groove that may be provided at one of the movable part and the suction part, and a guide protrusion that may be provided at the other one of the movable part and the suction part, and where the guide protrusion is accommodated in the guide groove. The tilting limitation part may include a guide groove that may be provided at one of the movable part and the suction part, and a guide protrusion that may be provided at the other one of the movable part and the suction part and where the guide protrusion may be accommodated in the guide groove. The movable part may include a plurality of side frames configured to connect to the suction part, and a front frame that may be configured to connect to front ends of the plurality of side frames, and where the front frame covers the front suction port from being exposed to the outside based on the suction part being located within the hood casing, and where the front suction port may be located under the front frame based on the suction part being withdrawn. The suction part may include a plurality of suction modules, each of the plurality of suction modules having a different tilting angle with respect to a lower surface of the hood casing, and where each of the plurality of suction modules comprises a front suction port. A suction module with a greatest tilting angle with respect to the lower surface of the hood casing, from among the plurality of suction modules, may include a bottom suction port.

The suction part may include a first suction module that may be tilted with respect to a lower surface of the hood casing by a first angle, and a second suction module that may be connected to the first suction module and tilted with respect to the lower surface of the hood casing by a second angle, the second angle being greater than the first angle. The hood may include a first tilting limitation part, configured to limit a tilting angle of the first suction module, and a second tilting limitation part, configured to limit a tilting angle of the second suction module. The first tilting limitation part may include a first guide groove provided at one of the movable part and the first suction module, and a first guide protrusion provided at the other one of the movable part and the first suction module, and where the first tilting limitation part may be accommodated in the first guide groove, and where the second tilting limitation part comprises a second guide groove provided at one of the first suction module and the second suction module, and a second guide protrusion provided at the other one of the first suction module and the second suction module, and where the second tilting limitation part may be accommodated in the second guide groove. The suction part may be fixed to the hood casing, and the moving part may be configured to guide the air toward a front suction port based on the suction part being withdrawn from the hood casing. The hood casing may include a bottom plate and a bottom suction port provided at the bottom plate, where the bottom suction port may be configured to suction the air. The movable part may include a sliding member, and an extension part that extends downward from a front end of the sliding member, and where the extension part covers the front suction port based on the sliding member being inserted into the hood casing. The suction part may include an opening that enables the sliding member to be slid. The opening may be defined as a cut portion of an upper end of the suction part.

The hood further may include a rail assembly that may be configured to allow the movable part to slide along the rail assembly, the hood casing may include a bottom plate and a rail support part that is provided at the bottom plate, and the rail assembly may include a fixed rail, which may be fixed to the rail support part, and a moving rail that may be connected to the fixed rail and the sliding member. A limitation mechanism that limits a withdrawing position of the movable part, where the limitation mechanism may include a stopper provided at the hood casing, and a protrusion portion that may be provided at the movable part and may be in contact with the stopper based on the movable part being moved along the rail assembly.

According to another aspect, a cooking device may include a main body with a cooking space where food is cooked and a hood provided at a lower side of the main body, where the hood may be configured to suction air and where the hood may include a hood casing, a movable part that may be configured to be withdrawn from the hood casing and a suction part that is tiltably connected to the movable part and configured to tilt downward based on being withdrawn from the hood casing together with the movable part, and where the suction part comprises a front portion at which a front suction port may be provided.

The details of one or more implementations are set forth in the accompanying drawings and the description below. Other features will be apparent from the description and drawings, and from the claims.

BRIEF DESCRIPTION OF THE DRAWINGS

The implementations will be described in detail with reference to the following drawings in which like reference numerals refer to like elements, and wherein.

DETAILED DESCRIPTION

Reference will now be made in detail to the implementations of the present disclosure, examples of which are illustrated in the accompanying drawings.

In the following detailed description of the preferred implementations, reference is made to the accompanying drawings that form a part hereof, and in which is shown by way of illustration specific preferred implementations. It is understood that other implementations may be utilized and that logical structural, mechanical, electrical, and chemical changes may be made without departing from scope of the disclosure. The following detailed description is not to be taken in a limiting sense.

Also, in the description of implementations, terms such as first, second, A, B, (a), (b) or the like may be used herein when describing components. Each of these terminologies is not used to define an essence, order or sequence of a corresponding component, but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
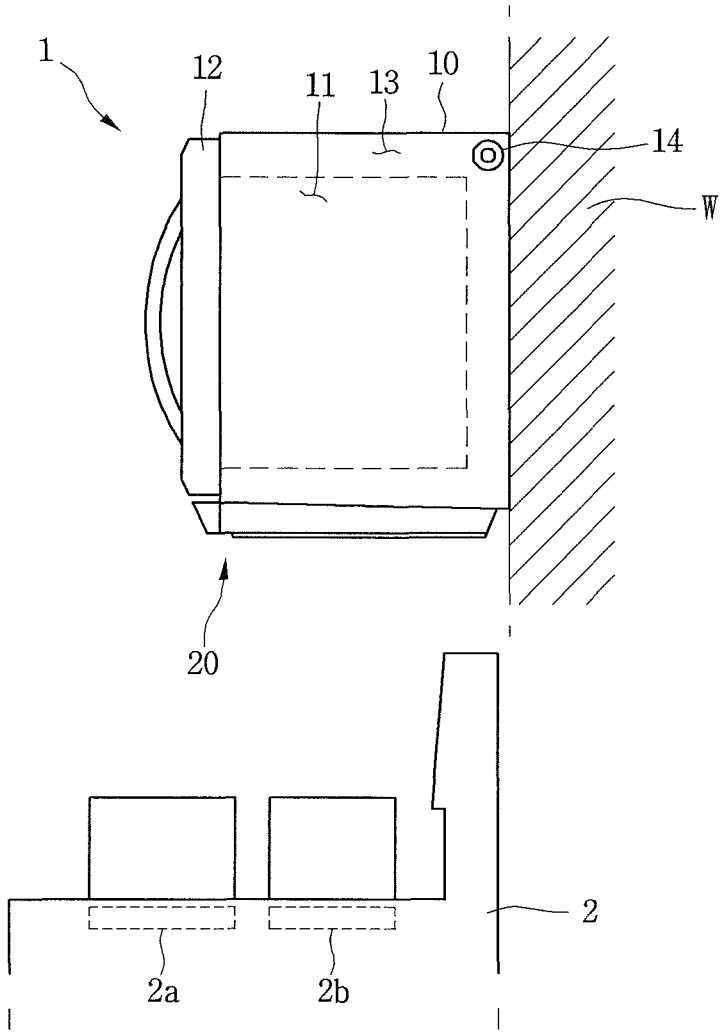
FIG. 1 is a view illustrating an example cooking device.
Figure 2:
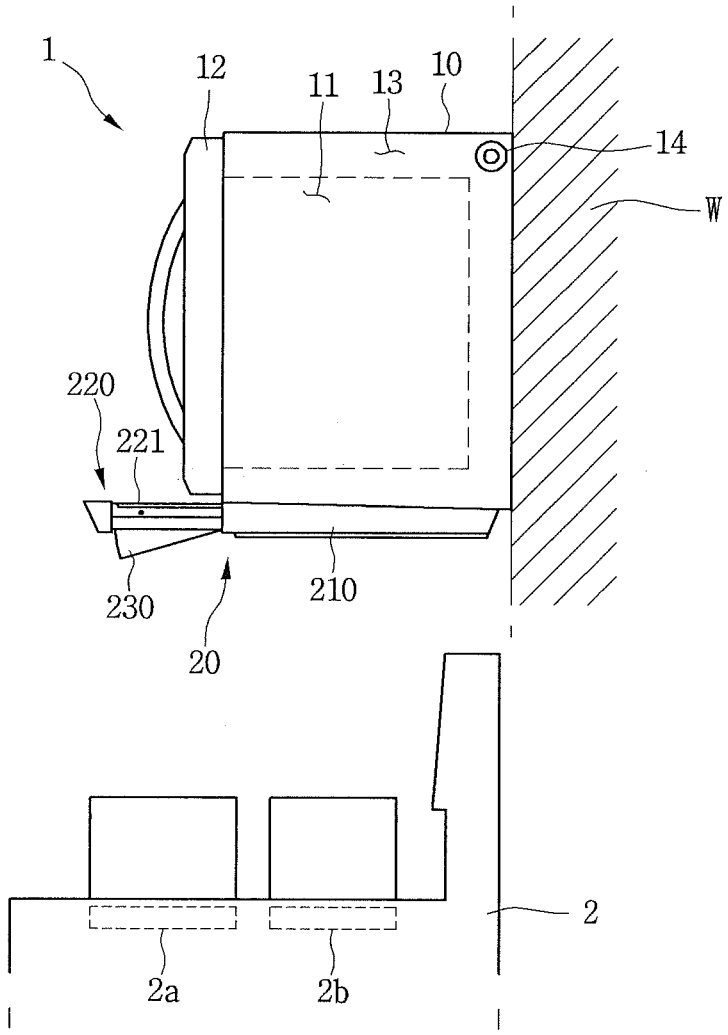
FIG. 2 is a view illustrating a state in which a suction mechanism is withdrawn from a hood of the cooking device.
Figure 3:
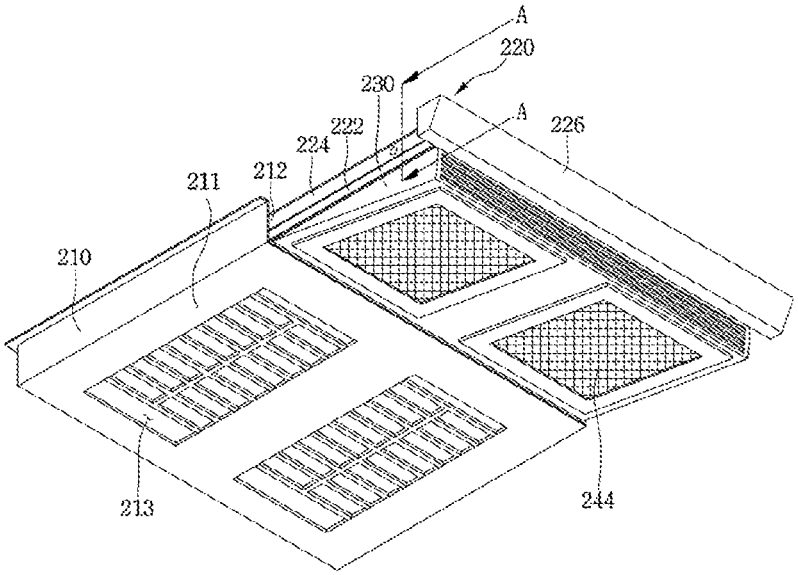
FIG. 3 is a perspective view illustrating the hood.
Figure 4:
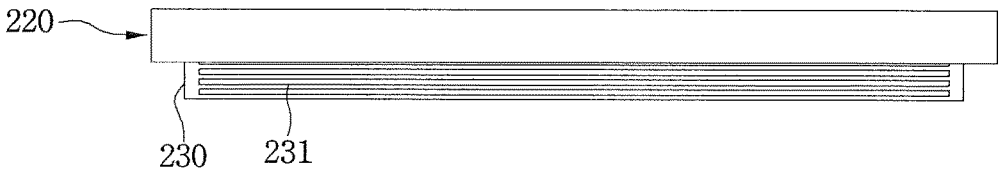
FIG. 4 is a front view of the hood.
Figure 5:
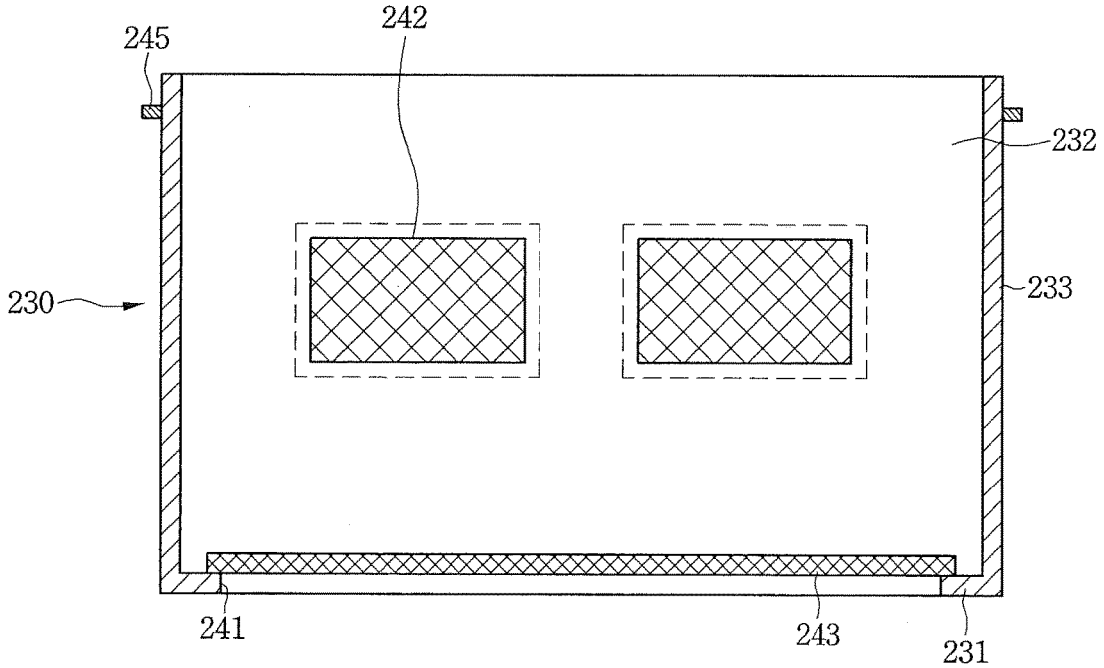
FIG. 5 is a cross-sectional view illustrating a suction part.

Referring to FIGS. 1 and 2, a cooking device 1 according to a first implementation may be installed, for example, at a wall W of a kitchen. That is, in the implementation, the cooking device 1 may be a wall-mounted microwave oven. While the cooking device 1 may be installed at the wall W, a type of the cooking device 1 is not limited.

The cooking device 1 may include a main body 10 that includes a cooking space 11 and a door 12, which is connected with the main body 10 to open and close the cooking space 11. Therefore, the cooking device 1 may perform cooking of food accommodated in the cooking space 11. The cooking device 1 may further include a hood 20 for suctioning external contaminated air. Although not limited, the hood 20 may be disposed at a lower side of the main body 10. The main body 10 may further include a suction fan 14 which is operated to suction the contaminated air, and an air path 13 through which the contaminated air flows. Although not shown in the drawings, a discharge port through which the contaminated air flows through the air path 13 may be provided at a front surface and/or an upper surface of the main body 10. As another example, the suction fan 14 may be provided at the hood 20.

For example, the cooking device 1 may be located above another cooking device 2 in the kitchen. The hood 20 may suction contaminated air generated while food is cooked by the other cooking device 2. The other cooking device 2 may include a front heating part 2*a* and a rear heating part 2*b*, but is not limited thereto. The front heating part 2*a* and the rear heating part 2*b* are spaced apart from each other in a longitudinal direction.

The hood 20 may include suction mechanisms. The suction mechanisms 220 and 230 may be configured to be inserted into or withdrawn from the hood 20.

In a state in which the suction mechanism is withdrawn from the hood 20, the hood 20 may suction the contaminated air generated while the food is cooked by the front heating part 2*a* and/or the rear heating part 2*b*.

Hereinafter, an example hood will be described in detail.

Referring to FIGS. 2 to 5, the hood 20 may include a hood casing 210, which may be connected to a lower side of the main body 10. The hood casing 210 may include a bottom plate 211. A suction port 213, through which the contaminated air is suctioned, may be provided at the bottom plate 211 of the hood casing 210. The hood 20 may further include the suction mechanisms for suctioning the contaminated air. The suction mechanism 220 and 230 may be connected to the hood casing 210 so as to be inserted therein or withdrawn therefrom.

To insert or withdraw the suction mechanisms, the hood casing 210 may include a front opening 212. The suction mechanisms may be withdrawn toward a front of the hood casing 210 through the front opening 212. The suction mechanisms may comprise a movable part 220 that is slidably connected to the hood casing 210, and a suction part 230 that is tiltably connected to the movable part 220. When the movable part 220 is withdrawn toward the front of the hood casing 210, the suction part 230 may be withdrawn toward the front together with the movable part 220 and then may be tilted downward.

The movable part 220 may include a frame of which at least a lower surface is open. The frame may include a plurality of side frames 222 that are connected to the hood casing 210 by a rail assembly 224, a front frame 226 that is connected to front ends of the plurality of side frames 222, and an upper frame 221 that connects the plurality of side frames 222 with each other. The plurality of side frames 222 may be disposed to be spaced apart from each other in a transverse direction. Since the plurality of side frames 222 may be disposed to be spaced apart from each other in the transverse direction, the suction part 230 may be located among the plurality of side frames 222. The suction part 230 may be movably connected to the movable part 220. For example, the suction part 230 may be tiltably connected to the movable part 220. The suction part 230 may include a front portion 231, a bottom portion 232 and a plurality of side portions 233.

A front suction port 241 through which the contaminated air is suctioned may be provided at the front portion 231. A first filter 243 for filtering the contaminated air suctioned through the front suction port 241 may be coupled to the front portion 231. The first filter 243 may be coupled to a front surface or a rear surface of the front portion 231. A bottom suction port 242 through which the contaminated air is suctioned may be provided at the bottom portion 232. A second filter 244 for filtering the contaminated air suctioned through the bottom suction port 242 may be coupled to the bottom portion 232. The second filter 244 may be coupled to a lower surface or an upper surface of the bottom portion 232. A shaft 245 which provides a rotational center for tilting may be provided at each of the plurality of side portions 233. The shaft 245 may be connected to each of the side portions 233 of the movable part 220. Alternatively, the shaft 245 may be provided at each of the plurality of side frames 222.

To tilt the front portion side of the suction part 230 in a state in which the suction part 230 is connected to the movable part 220, the shaft 245 may be located at a rear end side of each of the plurality of side portions 233. In the specification, front ends of the plurality of side portions 233 are portions which are connected to the front portion 231, and rear ends thereof are portions which are located at a position opposite to the front ends. For example, the plurality of side portions 233 may be formed in a fan shape. At this time, the plurality of side portions 233 may be formed so that an area thereof may be gradually increased from the shaft 245 toward the front portion 231. Since the plurality of side portions 233 may be formed in the fan shape, an overlapping portion with the side frames 222 may be reduced in a state in which the suction part 230 is tilted. That is, when the side portions 233 may be formed in a quadrangular plate shape, the overlapping portion of the side portion 233 and the side frames 222 may be increased in the state in which the suction part 230 is tilted, and since the overlapping portion is not exposed to an outside by the side frames 222, it does not functions as the suction part.

When the plurality of side portions 233 are formed in the fan shape, the overlapping portion of the side frames 222 may be minimized in the state in which the suction part 230 is tilted, and thus a material cost of the suction part 230 may be reduced, and a weight thereof may also be reduced. Further, when the plurality of side portions 233 are formed in the fan shape, the plurality of side portions 233 may be prevented from interfering with the upper frame 221 of the movable part 220 while the suction part 230 is being tilted.

Figure 6:
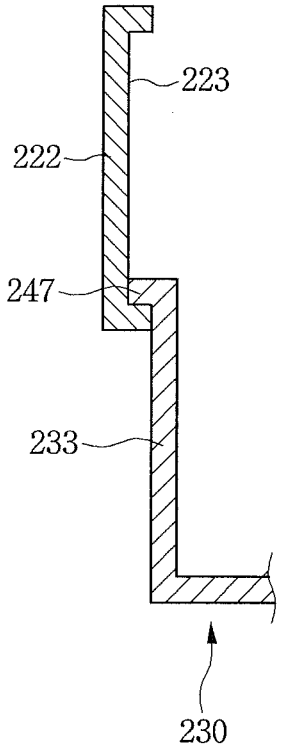
FIG. 6 is a cross-sectional view taken along line A-A of FIG. 3.
Figure 7:
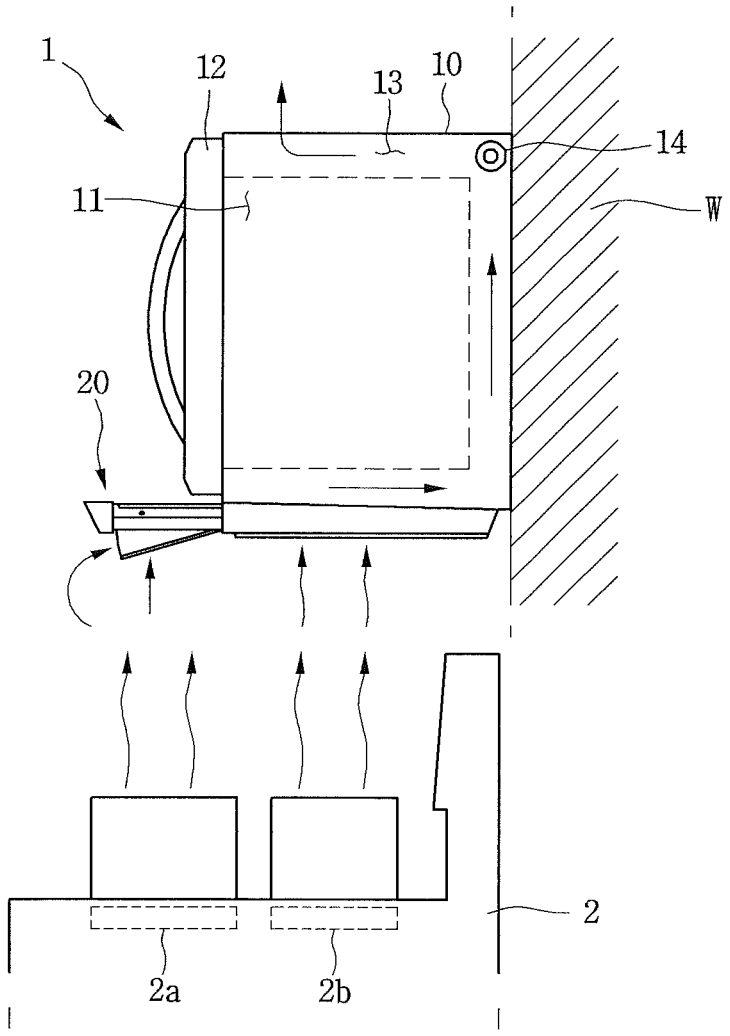
FIG. 7 is a view illustrating a state in which contaminated air is suctioned through the hood of the cooking device.

Referring to FIG. 6, a guide protrusion 247 may be provided at the side portion 233 of the suction part 230, and a guide groove 223 that accommodates the guide protrusion 247 may be provided at the side frame 222 of the movable part 220. Alternatively, the guide groove 223 may be provided at the side portion 233 of the suction part 230, and the guide protrusion 247 that is accommodated in the guide groove may be provided at the side frame 222 of the movable part 220. Although not clearly illustrated in the drawing, the guide groove 223 may be formed to be rounded so the guide protrusion 247 is moved along the guide groove 223 while the suction part 230 is being tilted.

The guide protrusion 247 and the guide groove 223 not only serve to guide the tilting of the suction part 230, but also limit the tilting of the suction part 230 in a state in which the suction part 230 is tilted at a predetermined angle. When the guide protrusion 247 is in contact with a lower end of the guide groove 223 while the suction part 230 is being tilted, the guide protrusion 247 may not move anymore, and thus the tilting of the suction part 230 is limited. In this disclosure, the guide protrusion 247 and the guide groove 223 may be referred to as a tilting limitation part that limits the tilting of the suction part 230.

Referring to FIGS. 3 to 7, the suction fan 14 may be operated to suction the contaminated air generated during a cooking process using the other cooking device 2. A user may pull the movable part 220 forward and may withdraw the suction part 230 from the hood casing 210. The user may manually pull the movable part 220 and may slide the movable part 220. Alternatively, a driving part for automatically withdrawing the movable part 220 may be provided at the hood 20, and thus the movable part 220 may be automatically slid by the driving part.

When the suction part 230 is located in the hood casing 210, at least a part of the bottom portion 232 of the suction part 230 is seated on the bottom plate 211 of the hood casing 210. And in this state, the front portion 231 of the suction part 230 is located at a rear of the front frame 226 of the movable part 220. Therefore, the front frame 226 may cover the front suction port 241 of the suction part 230. When the suction part 230 is located in the hood casing 210, the front frame 226 may cover the front suction port 241 of the suction part 230, and prevents the front suction port 241 from being exposed to the outside. Accordingly, foreign substances may be prevented from being introduced into the hood casing 210 through the front suction port 241, and an aesthetic sense may be enhanced.

While the movable part 220 is being slid to a front of the hood casing 210, the suction part 230 may be withdrawn forward from the hood casing 210 and may then tilted downward. When the suction part 230 is tilted downward, the front suction port 241 of the suction part 230 is exposed to the outside, and thus is in a state which is able to suction the contaminated air. That is, when the suction part 230 is tilted, the front suction port 241 is located under the front frame 226 of the movable part 220. Therefore the bottom suction port 242 is also exposed, when the movable part 220 is slid toward the front of the hood casing 210.

As described above, when the suction part 230 is being tilted, the tilting of the suction part 230 may be limited by the tilting limitation part. Accordingly, when the suction part 230 is tilted, and the front suction port 241 and the bottom suction port 242 are exposed to the outside, a suction force generated by an operation of the suction fan 14 acts on the front suction port 241 and the bottom suction port 242. When food is cooked by the front heating part 2*a* and the rear heating part 2*b* of the other cooking device 2, some or all of the contaminated air generated while the food is cooked by the rear heating part 2*b* may be suctioned into the suction port 213 of the hood casing 210. Some of the contaminated air generated while the food is cooked by the rear heating part 2*b* may be suctioned into the suction part 230. The contaminated air generated while the food is cooked by the front heating part 2*a* may be suctioned into the suction part 230.

The contaminated air generated while the food is cooked by the front heating part 2*a* rises. Some of the rising contaminated air may be suctioned through the bottom suction port 242 of the suction part 230. In addition, some of the contaminated air rises toward the front frame 226 of the movable part 220. At this time, since a suction force acts on the front suction port 241 of the suction part 230, the contaminated air rising toward the front frame 226 of the movable part 220 may not flow over the front frame 226 and may not flow above the movable part 220, but a flowing direction thereof may be switched toward the front suction port 241 and may be suctioned through the front suction port 241.

The contaminated air suctioned through the front suction port 241 and the contaminated air suctioned through the bottom suction port 242 flow through a space formed by the side frame and the upper frame of the movable part 220, and then may be suctioned into the hood casing 210. Therefore, according to this implementation, since the contaminated air may be suctioned through the front suction port 241 of the suction part 230, suction performance of the contaminated air may be enhanced.

The above-described implementation has described that the bottom suction port was provided at the bottom plate of the hood casing. However, the suction port may be omitted. Also, the above-described implementation has described that the bottom suction port was formed at the bottom part of the suction part 230. However, the bottom suction port may also be omitted.

Figure 8:
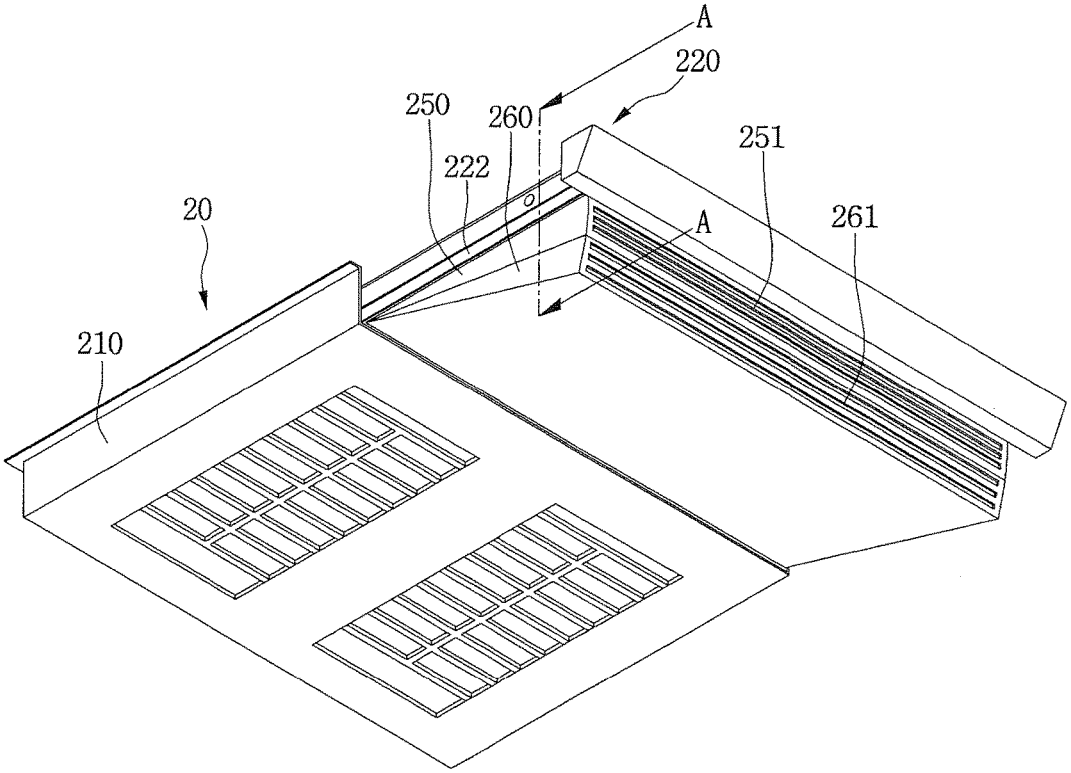
FIG. 8 is a view illustrating a hood of a cooking device.
Figure 9:
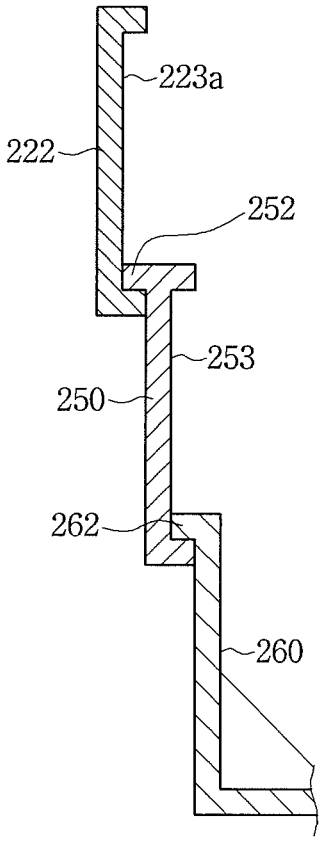
FIG. 9 is a cross-sectional view taken along line A-A of FIG. 8.

Referring to FIGS. 8 and 9, a hood 20 according to the implementation may include a hood casing 210 and a suction mechanism.

The suction mechanism may include a movable part 220, and a suction part 250 and 260. The movable part 220 has the same structure as the movable part of the first implementation. The suction part 250 and 260 may include a first suction module 250 which may be tiltably connected to the movable part 220, and a second suction module 260 which may be tiltably connected to the first suction module 250. The first suction module 250 may be tilted with respect to a lower surface of the hood casing 210 by a first angle, and the second suction module 260 may be tilted with respect to the lower surface of the hood casing 210 by a second angle greater than the first angle.

The first suction module 250 and the second suction module 260 may be tilted using a single shaft as a tilting center. Alternatively, the first suction module 250 may be connected to the movable part 220 by a first shaft and may be tilted, and the second suction module 260 may be connected to the first suction module 250 by a second shaft and may be tilted with respect to the first suction module 250. That is, when the first suction module 250 is tilted, the second suction module 260 may be tilted as well, and the second suction module 260 may be tilted with respect to the first suction module 250 independently from the tilting of the first suction module 250.

At this time, a width of the second suction module 260 may be smaller than that of the first suction module 250. Therefore, when the first suction module 250 and the second suction module 260 are inserted into the hood casing 210, the first suction module 250 and the second suction module 260 may not interfere with each other, and the second suction module 260 may be located within an area defined by the first suction module 250.

The first suction module 250 may include a first front suction port 251, and the second suction module 260 may include a second front suction port 261. The second suction module 260 may include a bottom suction port. A tilting angle of the first suction module 250 may be limited by a first tilting limitation part, and a tilting angle of the second suction module 260 may be limited by a second tilting limitation part.

The first tilting limitation part may include a first guide groove 223*a*, which is provided at the movable part 220, and a first guide protrusion 252, which is provided at the first suction module 250 and accommodated in the first guide groove 223*a*. Alternatively, the first guide protrusion 252 may be provided at the movable part 220, and the first guide groove 223*a* may be provided at the first suction module 250. Although not clearly illustrated in the drawings, the first guide groove 223*a* may be formed to be rounded so the first guide protrusion 252 is moved along the first guide groove 223*a* while the first suction module 250 is being tilted.

The second tilting limitation part may include a second guide groove 253, which is provided at the first suction module 250, and a second guide protrusion 262, which is provided at the second suction module 260 and accommodated in the second guide groove 253. Alternatively, the second guide protrusion may be provided at the first suction module 250, and the second guide groove may be provided at the second suction module 260. Although not clearly illustrated in the drawings, the second guide groove 253 may be formed to be rounded so the second guide protrusion 262 may be moved along the second guide groove 253 while the second suction module 260 is being tilted. In one implementation, since the contaminated air may also be suctioned through the front suction ports 251 and 261 of the plurality of suction module 250 and 260, the suction performance of the contaminated air may be enhanced.

The implementation has described that two suction modules were tilted. However, it may be configured so that three or more suction modules are tilted. In such a case, each of the plurality of suction modules includes the front suction port, and the suction module (the suction part located at the lowermost side) having the greatest tilting angle with respect to the lower surface of the hood casing may further include the bottom suction port.

Figure 10:
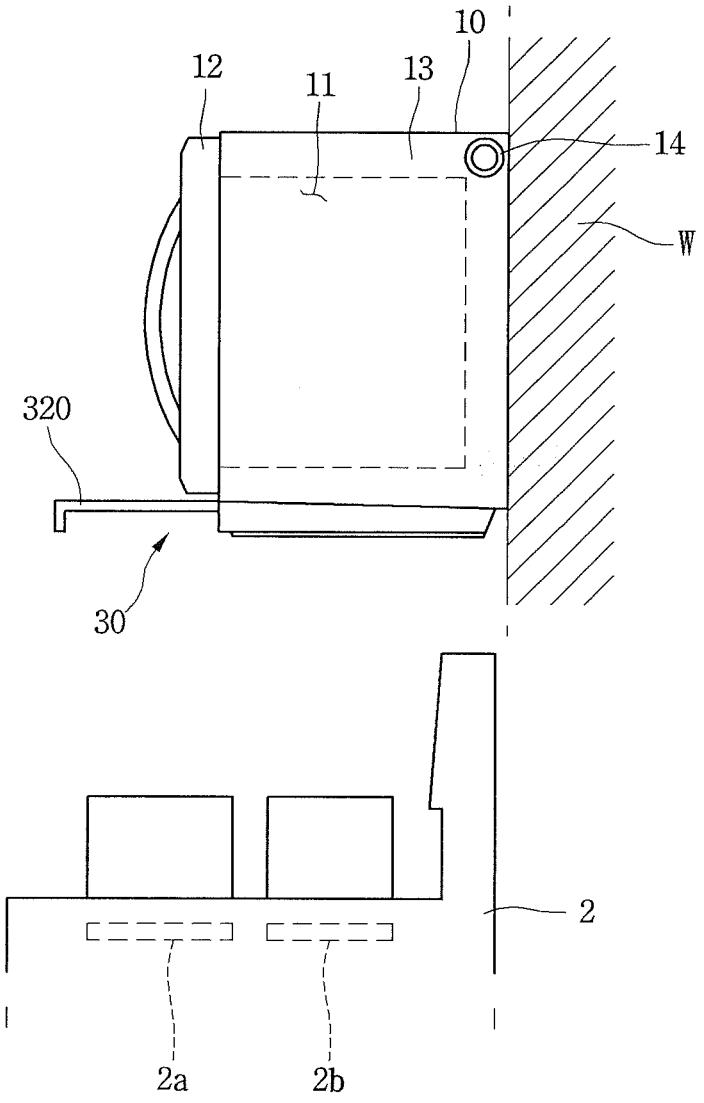
FIG. 10 is a view illustrating a state in which a guide member is withdrawn from a hood of a cooking device.

Referring to FIG. 10, a hood 30 of the implementation includes a guide member 320 which guides the contaminated air. The guide member 320 may be provided to be inserted into or withdrawn from the hood 30. The guide member 320 may be referred to as the movable part. When the guide member 320 is withdrawn from the hood 30, the hood 30 may effectively suction the contaminated air generated when the food is cooked by the front heating part 2*a* and/or the rear heating part 2*b*.

Figure 11:
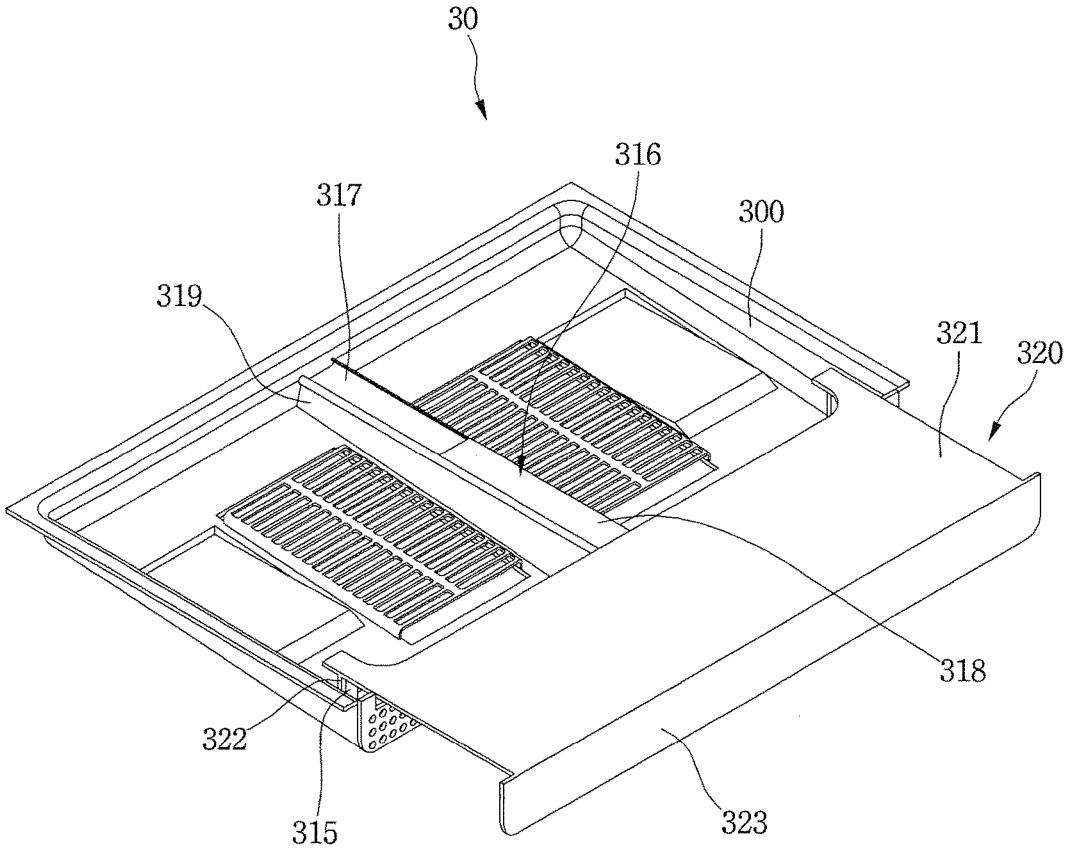
FIGS. 11 and 12 are perspective views illustrating the hood.
Figure 12:
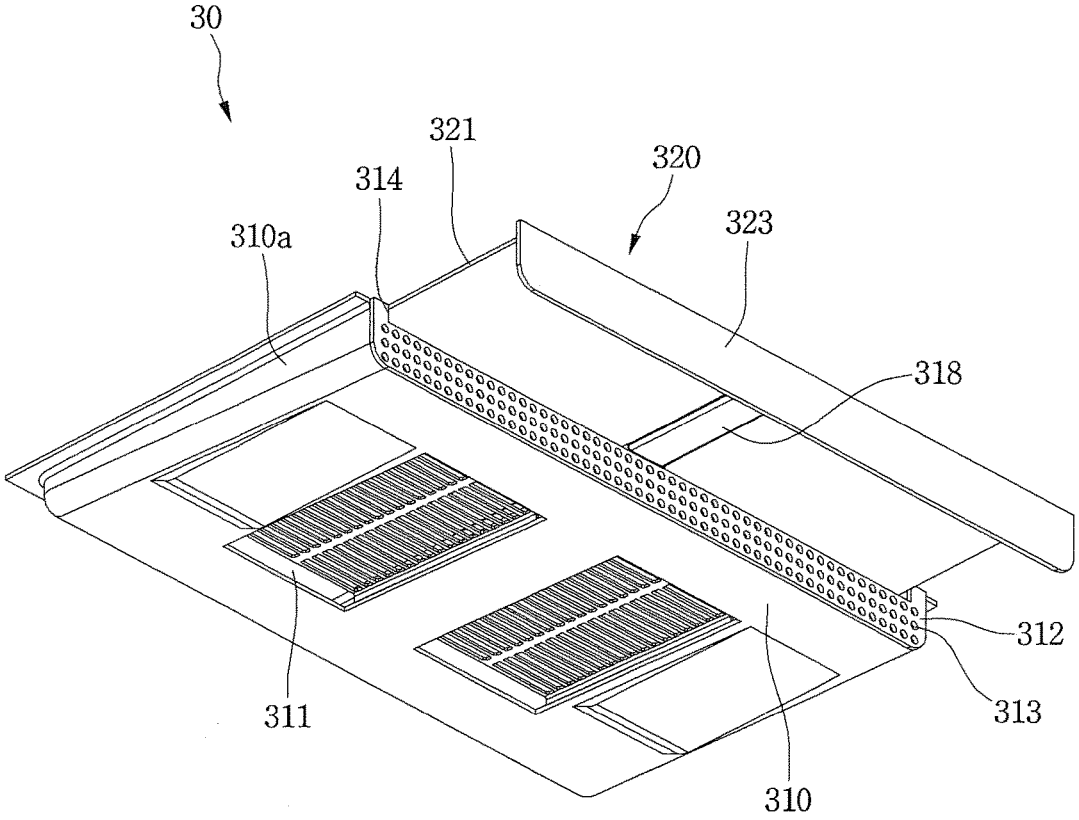

Referring to FIGS. 11 and 12, the hood 30 according to the third implementation may include a hood casing 300, which is configured to be connected to the lower side of the main body 10. The hood casing 300 may include a bottom plate 310. A bottom suction port 311 that suctions the contaminated air may be provided at the bottom plate 310 of the hood casing 300.

The hood casing 300 may include a suction part. The suction part may include a front suction port 313. The suction part may further include a front plate 312. The front suction port 313 may be provided at the front plate 312. The front suction port 313 may include a plurality holes. The plurality holes may be disposed to be horizontally or vertically spaced apart from each other, or may be disposed to be horizontally and vertically spaced apart from each other. The hood 30 may further include the guide member 320 which guides the contaminated air toward the front suction port 313. The guide member 320 may be slidably connected to the hood casing 300. When the guide member 320 is withdrawn from the hood casing 300, the front suction port 313 of the suction part may be exposed to the outside.

The guide member 320 may be slid and inserted into or withdrawn from the hood casing 300 by a rail assembly 316 in a longitudinal direction. The rail assembly 316 may include a fixed rail 317, and a moving rail 318 that is connected to the fixed rail 317. The moving rail 318 may be connected to the guide member 320. The hood casing 300 may include a rail support part 319 which is configured to support the fixed rail 317 to allow the guide member 320 to be slid at a position spaced apart from the bottom plate 310 by a predetermined height. The fixed rail 317 may be fixed to the rail support part 319.

The guide member 320 may include a sliding member 321 which is connected to the moving rail 318, and an extension part 323 which extends downward from a front end of the sliding member 321. The extension part 323 may serve as a handle which may be gripped by the user. The user may grip the extension part 323 and then may push or pull the guide member 320. The moving rail 318 may be connected to a lower surface of the sliding member 321. An opening 314 may be provided at the front plate 312 so that the sliding member 321 is withdrawn to the outside of the hood casing 300 or inserted into the hood casing 300 therethrough. The sliding member 321 and the moving rail 318 may be moved without interfering with the front plate 312 due to the opening 314.

For example, the opening 314 may be formed by cutting away a part of an upper end of the front plate 312. Alternatively, the opening 314 may be a groove that is formed by recessing a part of the upper end of the front plate 312. Conversely, the opening 314 may be a space that is formed according to a formation of the front plate 312, which is formed smaller than a height of a side plate 310*a*. The extension part 323 may cover the front suction port 313 of the front plate 312 when the sliding member 321 is inserted into the hood casing 300.

When the hood 30 is not in use, i.e., when the sliding member 321 is inserted into the hood casing 300, the extension part 323 covers the front suction port 313. Accordingly, the front suction port 313 is not exposed to the outside, and foreign substances may be prevented from being introduced through the front suction port 313, and an aesthetic sense may be enhanced.

A width of the extension part 323 may be larger than that of the sliding member 321. Therefore, when the sliding member 321 is inserted into the hood casing 300, the extension part 323 may cover the front plate 312.

Figure 13:
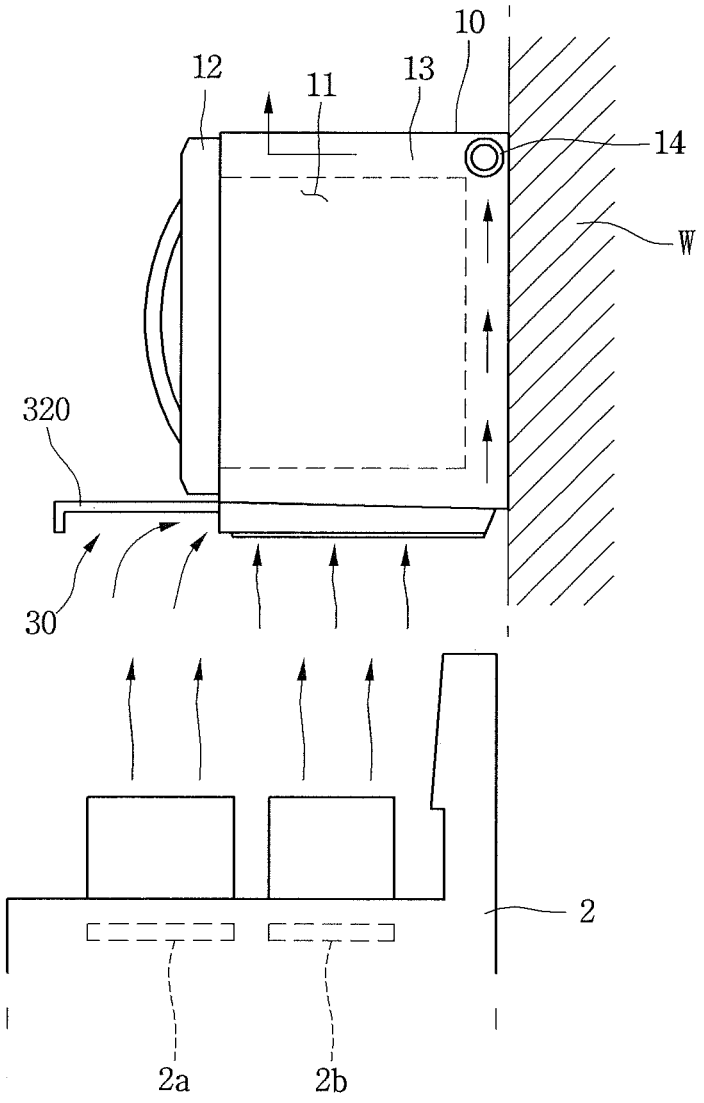
FIG. 13 is a view illustrating a state in which contaminated air is suctioned through the hood of the cooking device.

The hood 30 may further include a limitation mechanism which limits a withdrawing position of the guide member 320. The limitation mechanism may include a stopper 315, which is provided at the bottom plate 310 of the hood casing 300, and a protrusion portion 322, which is provided at the sliding member 321. When the protrusion portion 322 is in contact with the stopper 315 while the guide member 320 is being withdrawn forward from the hood casing 300, withdrawing of the guide member 320 is limited. At this time, the stopper 315 may be provided at the side plate 310*a* of the hood casing 300. Referring to FIGS. 11 to 13, the suction fan 14 may be operated to suction the contaminated air generated during the cooking process using the other cooking device 2. Also, the user may pull the guide member 320 toward a front of the hood casing 300. Then, the front suction port 313 is exposed to the outside, and a suction force generated by an operation of the suction fan 14 acts on the front suction port 313 and the bottom suction port 311.

When the food is cooked by the front heating part 2*a* and the rear heating part 2*b* of the other cooking device 2, some or all of the contaminated air generated while the food is cooked by the rear heating part 2*b* may be suctioned into the bottom suction port 311. Some of the contaminated air generated while the food is cooked by the rear heating part 2*b* may be suctioned into the front suction port 313. Some or all of the contaminated air generated while the food is cooked by the front heating part 2*a* may be suctioned into the front suction port 313. The contaminated air generated while the food is cooked by the front heating part 2*a* rises. While the contaminated air is rising, a flow of the contaminated air may be guided by the guide member 320.

At this time, some of the contaminated air may rise toward the extension part 323 of the guide member 320. In this case, since the suction force acts on the front suction port 313, the contaminated air rising toward the extension part 323 may not flow over the extension part 323 and may not flow above the guide member 320, but a flowing direction thereof may be switched toward the front suction port 313 and may be suctioned into the hood casing 300 through the front suction port 313. Therefore, since the contaminated air can be suctioned through the front suction port 313, the suction performance of the contaminated air can be enhanced. Also, since the contaminated air can be suctioned through the front suction port 313, a length of the guide member can be reduced. An example in which the bottom suction port is provided at the bottom plate has been described above. However, the bottom suction port can be omitted.

Even though all the elements of the implementations are coupled into one or operated in the combined state, the present disclosure is not limited to such an implementation. That is, all the elements may be selectively combined with each other without departing the scope of the disclosure. Furthermore, when it is described that one element comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms need to be construed as meanings used in technical contexts and are not construed as ideal or excessively formal meanings unless otherwise clearly defined herein.

Although implementations have been described with reference to a number of illustrative implementations thereof, it will be understood by those skilled in the art that various changes in form and details may be made therein without departing from the scope of the appended claims. Therefore, the preferred implementations should be considered in a descriptive sense only and not for purposes of limitation, and also the technical scope is not limited to the depicted implementations. Furthermore, the disclosure is defined, not by the detailed description, but by the appended claims, and all differences within the scope will be construed as being comprised in the present disclosure.

What is claimed is:

1. A cooking device comprising:

a main body with a cooking space where food is cooked; and a hood provided at a lower side of the main body, wherein the hood is configured to suction air;

wherein the hood comprises:

a hood casing;

a movable part that is configured to be withdrawn from the hood casing; and a suction part that includes a bottom wall, a front wall and side walls, and that is tiltably connected to the movable part, wherein the suction part is configured to tilt downward based on being withdrawn from the hood casing together with the movable part, wherein the suction part is tilted downward while being withdrawn from the hood casing together with the movable part, wherein a front suction port is formed on the front wall of the suction part and a bottom suction port is formed on the bottom wall of the suction part, wherein the front suction port and the bottom suction port are exposed to an outside of the hood casing based on the movable part being withdrawn from the hood casing, and wherein the front suction portion and the bottom suction port are not exposed to the outside of the hood casing based on the movable part being inserted in the hood casing.

2. The cooking device according to claim 1, wherein the hood further comprises a tilting limitation part that limits a tilting angle of the suction part.

3. The cooking device according to claim 2, wherein the tilting limitation part comprises a guide groove that is provided at one of the movable part and the suction part, and a guide protrusion that is provided at the other one of the movable part and the suction part and wherein the guide protrusion is accommodated in the guide groove.

4. The cooking device according to claim 1, wherein the movable part comprises a plurality of side frames configured to connect to the suction part, and a front frame that is configured to connect to front ends of the plurality of side frames, and wherein the front frame covers the front suction port from being exposed to the outside based on the suction part being located within the hood casing, and wherein the front suction port is located under the front frame based on the suction part being withdrawn.

5. The cooking device according to claim 1, wherein the suction part comprises a plurality of suction modules, each of the plurality of suction modules having a different tilting angle with respect to a lower surface of the hood casing, and wherein each of the plurality of suction modules comprises the front suction port.

6. The cooking device according to claim 5, wherein, among the plurality of suction modules, a suction module with a greatest tilting angle with respect to the lower surface of the hood casing further comprises the bottom suction port.

7. The cooking device according to claim 1, wherein the suction part comprises a first suction module that is tilted with respect to a lower surface of the hood casing by a first angle, and a second suction module that is connected to the first suction module and tilted with respect to the lower surface of the hood casing by a second angle, the second angle being greater than the first angle.

8. The cooking device according to claim 7, wherein the hood further comprises a first tilting limitation part, configured to limit a tilting angle of the first suction module, and a second tilting limitation part, configured to limit a tilting angle of the second suction module.

9. The cooking device according to claim 8, wherein the first tilting limitation part comprises a first guide groove provided at one of the movable part and the first suction module, and a first guide protrusion provided at the other one of the movable part and the first suction module, and wherein the first tilting limitation part is accommodated in the first guide groove, and wherein the second tilting limitation part comprises a second guide groove provided at one of the first suction module and the second suction module, and a second guide protrusion provided at the other one of the first suction module and the second suction module, and wherein the second tilting limitation part is accommodated in the second guide groove.

10. A cooking device comprising:

a main body with a cooking space where food is cooked; and a hood provided at a lower side of the main body, wherein the hood is configured to suction air, wherein the hood comprises:

a hood casing;

a movable part that is configured to be withdrawn from the hood casing; and a suction part that is tiltably connected to the movable part and configured to tilt downward based on being withdrawn from the hood casing together with the movable part, and wherein the suction part comprises a front wall at which a front suction port is provided and a bottom wall at which a bottom suction port is provided.

11. A cooking device comprising:

a main body with a cooking space where food is cooked; and a hood provided at a lower side of the main body, wherein the hood is configured to suction air;

wherein the hood comprises:

a hood casing with a front plate and a bottom plate;

a front suction port provided at the front plate, through which the air is suctioned, and a movable part configured to guide the air toward the front suction port when the movable part is being withdrawn from the hood casing, wherein the movable part comprises a sliding member and an extension part that is configured to extend downward from a front end of the sliding member, wherein the extension part is configured to face the front plate and cover the front suction port when the sliding member is being inserted into the hood casing; and wherein the hood casing further comprises:

a bottom plate and a bottom suction port provided at the bottom plate, wherein the bottom suction port is configured to suction the air.

12. The cooking device according to claim 11, wherein the hood further comprises:

a rail assembly that is configured to allow the movable part to slide along the rail assembly, the hood casing comprises a rail support part that is provided at the bottom plate, and the rail assembly comprises a fixed rail, which is fixed to the rail support part, and a moving rail that is connected to the fixed rail and the sliding member.

13. The cooking device according to claim 11, further comprising: a limitation mechanism that is configured to limit a withdrawn position of the movable part, wherein the limitation mechanism comprises a stopper provided at the hood casing, and a protrusion portion that is provided at the movable part and is in contact with the stopper based on the movable part being moved along the rail assembly.

14. The cooking device according to claim 11, wherein the suction part has an opening that is configured to enable the sliding member to slide.

15. The cooking device according to claim 14, wherein the opening is defined as a cut portion of an upper end of the suction part.

* * * * *